US008764275B2

(12) United States Patent
Schönfeld et al.

(10) Patent No.: US 8,764,275 B2
(45) Date of Patent: Jul. 1, 2014

(54) METHOD FOR MIXING AND/OR CONVEYING, MIXING AND/OR CONVEYANCE DEVICE, AND SAMPLE PROCESSING CHIP COMPRISING SUCH AS DEVICE

(75) Inventors: Friedhelm Schönfeld, Mainz (DE); Malte Weniger, Hofheim-Wildsachsen (DE)

(73) Assignee: Institut für Mikrotechnik Mainz GmbH, Mainz (DE)

( * ) Notice: Subject to any disclaimer, the term of this patent is extended or adjusted under 35 U.S.C. 154(b) by 746 days.

(21) Appl. No.: 12/451,024

(22) PCT Filed: Apr. 21, 2008

(86) PCT No.: PCT/EP2008/054809
§ 371 (c)(1), (2), (4) Date: Oct. 22, 2009

(87) PCT Pub. No.: WO2008/129036
PCT Pub. Date: Oct. 30, 2008

(65) Prior Publication Data

US 2010/0128554 A1 May 27, 2010

(30) Foreign Application Priority Data

Apr. 24, 2007 (DE) ..... 10 2007 020 243

(51) Int. Cl.
*B01F 11/02* (2006.01)

(52) U.S. Cl.
USPC ..... 366/114; 366/127

(58) Field of Classification Search
USPC ..... 366/114, 115, 127
See application file for complete search history.

(56) References Cited

U.S. PATENT DOCUMENTS 5,114,074 A 5/1992 Frauenthal et al.
5,201,460 A 4/1993 Caines (Continued)

FOREIGN PATENT DOCUMENTS

DE 19923378 C2 11/2000
DE 100 13 311 C2 9/2001

(Continued)

OTHER PUBLICATIONS

R J Dijkink, et al., The 'acoustic scallop': a bubble-powered actuator, Journal of Miromechanics & Microengineering, Institute of Physics Pub, GB, Bd. 16, No. 8, 2006.

(Continued)

*Primary Examiner* — David Sorkin
(74) *Attorney, Agent, or Firm* — Hudak, Shunk & Farine Co., LPA

(57) ABSTRACT

A mixing and/or conveyance method and a mixing and/or conveyance device for a fluid substance, comprising a sample chamber, a cavity communicating with the sample chamber, said cavity being configured for accommodating a compressible medium, and a sound source that may be coupled to the compressible medium for the production of a fluctuation in pressure in the compressible medium. In the region of its mouth, the cavity is designed such that, in the case of an expansion in the volume of the compressible medium in the cavity, a directed fluid stream of the fluid substance escapes from the cavity through its mouth. A sample processing chip ('lab on a chip') comprising such a mixing and/or conveyance device.

15 Claims, 4 Drawing Sheets

(56) References Cited

U.S. PATENT DOCUMENTS

| | | | | |
|---|---|---|---|---|
| D440,810 | S | 4/2001 | Olson | |
| 6,210,128 | B1 | 4/2001 | Rife et al. | |
| 6,230,913 | B1 | 5/2001 | Cornell et al. | |
| 6,244,738 | B1 * | 6/2001 | Yasuda et al. | 366/114 |
| 6,431,434 | B1 | 8/2002 | Haughton et al. | |
| 6,460,777 | B2 | 10/2002 | Float et al. | |
| 6,676,032 | B2 | 1/2004 | Banach | |
| 6,745,949 | B2 | 6/2004 | Lee | |
| 6,811,822 | B2 | 11/2004 | Frese et al. | |
| 6,910,797 | B2 * | 6/2005 | Falcon | 366/127 |
| D532,242 | S | 11/2006 | Aikens | |
| D567,004 | S | 4/2008 | Bottega | |
| 7,731,101 | B2 | 6/2010 | Fabrizio et al. | |
| D638,244 | S | 5/2011 | Wallace | |
| D655,121 | S | 3/2012 | Wallace | |
| 2002/0185547 | A1 | 12/2002 | Kaplan | |
| 2003/0107946 | A1 * | 6/2003 | Cosby et al. | 366/127 |
| 2003/0133359 | A1 | 7/2003 | Bittner | |
| 2003/0175947 | A1 | 9/2003 | Liu et al. | |
| 2003/0230635 | A1 | 12/2003 | Banach | |
| 2004/0027915 | A1 | 2/2004 | Lowe et al. | |
| 2004/0076074 | A1 | 4/2004 | Shubeck | |
| 2004/0125689 | A1 | 7/2004 | Ehrfeld et al. | |
| 2006/0027675 | A1 | 2/2006 | Takeda | |
| 2007/0211562 | A1 | 9/2007 | Pitsis | |
| 2008/0186799 | A1 * | 8/2008 | Gauer | 366/127 |
| 2010/0135104 | A1 | 6/2010 | Schoenfeld | |

FOREIGN PATENT DOCUMENTS

| | | | |
|---|---|---|---|
| EP | 1311341 | A2 | 5/2003 |
| EP | 1390131 | A2 | 2/2004 |
| FR | 2770152 | | 4/1994 |
| GB | 2 333 047 | A | 7/1999 |
| WO | WO 2004/030800 | A2 | 4/2004 |
| WO | WO 2006/072384 | * | 7/2006 |
| WO | WO 2006/105616 | A1 | 10/2006 |
| ZA | 9809846 | A | 4/1999 |

OTHER PUBLICATIONS

R H Liu, et al., Bubble-induced acoustic micromixing, Lab on a Chip, Royal Society of Chemistry, GB, Bd. 2, 1, 2002, pp. 151-157, XP009103055.

Piotr Garstecki et al., "Design for mixing using bubbles in branched microfluidic channels", Applied physics letters 86, 244108 (2005).

* cited by examiner

METHOD FOR MIXING AND/OR CONVEYING, MIXING AND/OR CONVEYANCE DEVICE, AND SAMPLE PROCESSING CHIP COMPRISING SUCH AS DEVICE

FIELD OF THE INVENTION

The invention concerns a mixing and/or conveying method and a mixing and/or conveyance device for a fluid substance or liquid with a sample chamber, a cavity communicating with the sample chamber, designed to accommodate a compressible medium of given volume, and a sound source that may be coupled to the compressible medium for the production of a fluctuation in pressure in the compressible medium. The invention further relates to a sample processing chip ("lab on a chip") with such a mixing and/or conveyance device.

BACKGROUND OF THE INVENTION

Whereas various methods and devices such as magnetic agitators, vortex mixers and the like are used for the mixing of macroscopic quantities of liquids, these are usually unsuited for microscopic quantities of liquids. In particular, such mixing principles cannot be integrated into existing sample processing systems.

In microfluidics, therefore, passive mixing methods and devices are mainly used. Such mixing methods and mixers used in chemical process technology, and also usually with continuous operating mode, are known for example from EP 1311341 B1 or EP 1390131 B1. These methods and mixers are usually unsuited for the mixing of small volumes of liquid.

A new method is described in US 2003/0175947 A1 and in the article "Bubble-induced acoustic micromixing" by Robin H. Liu et al., LAB Chip, 2002, 2, 151-157. This presents a device for the mixing of very small volumes of liquid (22 μl), having a chamber, filled with the liquids being mixed, and cavities peripherally arranged and connected to the chamber. In the area of the cavities, air bubbles are captured and placed in resonant oscillation by acoustic excitation, so that the surrounding liquid is also placed in motion, leading to a faster blending as compared to diffusion mixing. In the corresponding model, the authors presume that the microflow created in this way is based on the frictional forces at the boundary surface between the liquid and the gas bubble.

This same mixing principle is also the basis for publications WO 2006/105616 A1 and WO 2004/030800 A2.

SUMMARY OF THE INVENTION

Accordingly, the basic problem of the invention is to achieve an improved mixing and pumping action.

The problem is solved for the mixing and/or conveyance device described at the outset in that the cavity is configured in the mouth region so that, in the case of an expansion in the volume of the compressible medium in the cavity, a directed fluid stream of the fluid substance escapes from the cavity through its mouth.

The method of the invention for mixing and/or conveying of a fluid substance in a sample chamber, especially for microfluidic mixing and/or conveying, accordingly calls for exciting a compressible medium in a cavity emerging into the sample chamber by means of sonic influence into a pressure oscillation, wherein a portion of the fluid substance penetrates into the mouth region of the cavity and as a result of an expansion in volume of the compressible medium it escapes from the cavity through its mouth in a directed fluid stream.

By sample chamber or chamber in the sense of the invention is meant quite generally any given shaped volume with one or more openings, in which the fluid substance is enclosed, or through which the fluid substance flows—even during the mixing.

The term cavity is understood here, unless otherwise specified, generally as a cavity of any given form. The term "opening" used hereafter describes the exit cross section of the cavity in a projection onto the surface of the body at the exit point. By mouth is meant the end segment or exit channel of the cavity near the opening.

As described above, the "bubbles" of the compressible medium trapped in the cavities are subjected to pressure fluctuations by acoustic excitation. But the expansion in volume of the compressible medium resulting from the pressure drop is used by the invention to create a directed fluid stream of the fluid substance through the mouth and out from the cavity. The cavity must therefore be configured in the region of the mouth so that a directed stream (or jet) exits from it, ensuring a transfer of momentum to the fluid substance found in the chamber. The direction of flow of the emerging fluid jet can be adjusted, on the one hand, by the orientation of the cavity or its mouth, and on the other hand by the arrangement of shape of the opening or by a combination of both features.

Preferably, the cavity has at least one channel-shaped mouth entering the sample chamber.

In one simple form, the cavity has, at least in the region of the mouth, a tubular segment with constant cross section, or in more complicated configuration a special nozzle geometry, to boost the efficiency of the propulsion, for example.

Thus, the invention makes use of a different principle, namely, at sufficiently large Reynold's number, Re≥around 50, a fluid emerging from a channel exits in the form of a directed jet, while a fluid sucked into the channel enters the channel equally from the entire available range of spatial angles. The principle is described in the article "The acoustic scallop: a bubble-powered actuator" by Dijkink et al., Journal of Micromechanics and Microengineering, 16, 2006, 1653-1659. Here, it is proposed to use the principle as propulsion for an "acoustic windmill". A Teflon tube closed at one end is accordingly dipped into a water-filled container, so that an air bubble is enclosed in its capillary. Sound by means of a piezoactuator is delivered through the water into the air bubble, thereby exciting an oscillation. The alternating expansion and contraction of the volume alternately sucks liquid into the tube and expels it again. Thanks to the described asymmetry between the directed expulsion and the nondirected suction, an overall transfer of momentum to the tube occurs in the course of one full oscillation, which is used for its propulsion in the direction of its lengthwise axis.

Unlike in the article, in the present case the principle is used not for propulsion, but to introduce a net momentum transfer into the standing or flowing liquid and thereby, in conjunction with the geometry of the sample chamber and the arrangement of the cavities, to achieve an increased swirling and thus an improved mixing of the liquids, on the one hand, and/or an (improved) transport of the liquids in a particular direction.

Preferably the surface of the cavity is oriented to not cause wetting, at least in part.

In this way, one makes sure that an air bubble enclosed in the cavity remains trapped there because of the surface tension of the fluid substance.

Especially preferably, the surface of the cavity is oriented to cause wetting in the region of the mouth.

This makes sure that a portion of the fluid substance or liquid, thanks to the capillary effect, enters at least into the region of the mouth and stands ready there as a liquid column to form the fluid stream.

A local wetting or non-wetting of the surfaces can be achieved by modification of the surface When used for an aqueous solution, the mixing and/or conveyance device is either formed from a hydrophobic material, for example, and made hydrophilic in the region of the mount and as far as necessary in other surface areas outside the cavity, or it is formed from a hydrophilic material and made hydrophobic in the region of the cavity (or cavities), and possibly outside of the mouth(s).

It can be made hydrophilic or hydrophobic in familiar fashion, by a dip method, as described in DE 10013311 C2, or by a coating. For example, polycarbonate, being a slightly hydrophobic material, can be made hydrophilic by an $O_2$ plasma treatment on the surface.

An alternative makeup has the cavity formed from a tube or hose segment or insert, for example, one made from polycarbonate or from polytetrafluorethylene, which is nonwettable (hydrophobic).

When using the mixing and/or conveyance device for nonpolar organic liquids, accordingly, lipophilic surfaces can be used in the region of the mouth and as far as necessary in other surface regions, as well as lipophobic surfaces in the region of the cavity (or cavities), possibly outside the mouth(s). This is done preferably by forming the mixing and/or conveyance device from a lipophilic material and making it lipophobic in the region of the cavity, possibly outside of the mouth, or by forming it from a lipophobic material and making it lipophilic in the region of the mouth and as far as necessary in other surface regions, outside of the cavity.

In one advantageous modification, the mixing and/or conveyance device has a pressure-increasing means in communication with the sample chamber, which is designed to apply a pressure to the fluid substance or liquid so that a portion of the fluid substance penetrates into the mouth region of the cavity under compression of the compressible medium.

Alternatively or in addition to the wettable mouth region, this also ensures that enough fluid substance is present as a liquid column to form the fluid stream in the mouth region of the cavity.

In one preferred embodiment of the method, the compressible medium emerges through the mouth or mouths relative to the sample chamber such that a net angular momentum is introduced into the fluid substance in the sample chamber. The corresponding mixing and/or conveyance device has cavities with mouths opening into the sample chamber, being arranged and oriented relative to the sample chamber so that the directed fluid streams exiting from the cavities through the mouths upon expansion in the volume of the compressible medium introduce a sum angular momentum into the fluid substance inside the sample chamber.

In this way, the entire liquid present in the sample chamber is placed in a rotational movement. This ensures an overall greater swirling in the overall sample chamber. The risk of not enough mixing taking place in "dead corners" is lessened.

In an alternative preferred embodiment of the method, the compressible medium emerges through the mouth or mouths relative to the sample chamber such that a net linear momentum is introduced into the fluid substance in the sample chamber. The corresponding mixing and/or conveyance device has cavities with mouths opening into the sample chamber, being arranged and oriented relative to the sample chamber so that the directed fluid streams exiting from the cavities through the mouths upon expansion in the volume of the compressible medium introduce a sum linear momentum into the fluid substance inside the sample chamber.

In this way, a pump effect is achieved, which delivers the fluid in the sample chamber in one direction, for example, from one inlet opening toward one outlet opening.

The cavity in the most simple and thus most cost-effective case is inserted in the form of a blind borehole or a channel closed at one end into one wall of the sample chamber.

Preferably, the sound source is coupled directly to one wall of the sample chamber.

If the sound source in one region of the sample chamber wall is connected to the mixing and/or conveyance device, which during operation is in contact with the fluid substance at the opposite side, the pressure oscillation is exported directly through the fluid substance and conveyed to the compressible medium. In this way, losses are avoided, such as those due to large impedance differences in the sound transmission, for example, because of an air/gas cushion next to the inside of the container wall.

In another advantageous embodiment, the cavity is in the form of a connection channel, which is connected on the one hand via the mouth to the sample chamber and on the other hand to a pressure chamber filled with a coupling medium, to which the sound source is coupled.

Thus, the pressure oscillation is delivered not via the substance being mixed but instead from the opposite side through the coupling medium located in the pressure chamber and into the compressible medium. Using an appropriate channel system for the coupling medium, one central pressure chamber can supply several or all cavities. It is advantageous for the cavities to be individually or groupwise actuated in the desired sequence by a valve control unit.

The compressible medium is preferably a gas, especially air.

BRIEF DESCRIPTION OF THE DRAWINGS

Further problems, features and benefits of the invention will be explained more closely below by means of sample embodiments with the help of the drawings. There are shown.

DETAILED DESCRIPTION OF THE INVENTION

Figure 1:
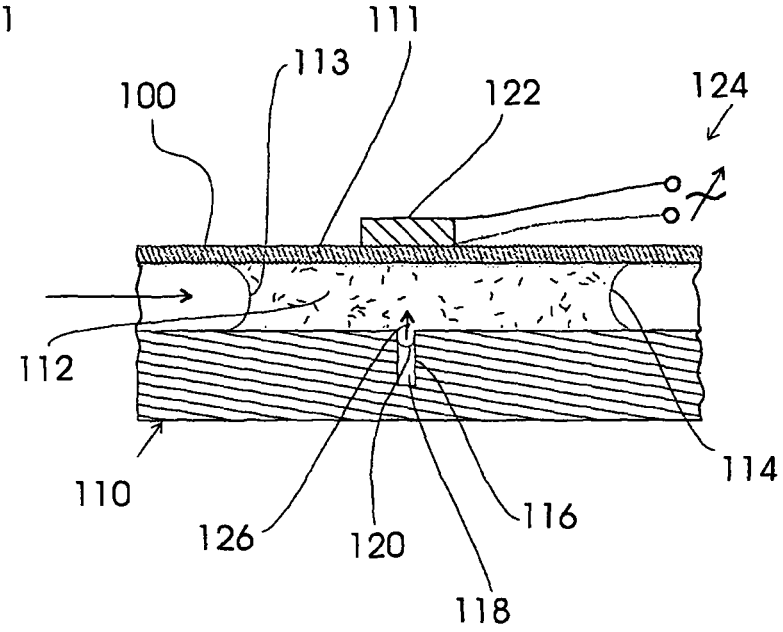
FIG. 1, a cross section through the mixing device of the invention in a sample processing chip according to a first embodiment, viewed from the side.

FIG. 1 shows the most simple embodiment of the invented mixing device. A sample chamber 100 in the form of a channel with constant cross section or a sample chamber broadening out transversely to the cross sectional plane is placed in a sample processing chip 110. A liquid drop 112 of the substance being mixed (hereinafter also known as the "plug"), recognizable from the boundary surfaces 113 and 114 with the surrounding air/gas, is delivered by a pump (not shown), for example, through the channel 100.

Transversely to the channel 100 is located a cavity 116, in this case emerging into the channel 100 from below, and being designed in the shape of a small, unvented channel or blind borehole. If the liquid drop 112 reaches the region around the cavity 116, as shown in FIG. 1, an air or gas bubble 118 becomes enclosed as compressible medium in the cavity 116.

It is critical to the mode of action of the invention that the liquid being mixed penetrates at least partly into the mouth region of the cavity 116 and provides here a liquid column, indicated by the boundary surface 120 between the air bubble 118 and the liquid plug 112. Two different mechanisms can be used optionally or at the same time to form this liquid column. First, one can make sure that the cavity 116 is wetted in its mouth region. This can be achieved by an appropriate choice of the material of the cavity in the mouth region, i.e., possibly by a surface modification, for example, if the cavity is formed from a material not otherwise wettable. Alternatively or additionally, the liquid plug 112 can be subjected to pressure from the pump connected to the channel 100, so that the air bubble 118 enclosed in the cavity is compressed. A suitable provision must make sure that the liquid plug 112 is located exactly above the cavity 116 when the nominal pressure is attained. This can be done by applying pressure to both sides of the liquid plug 112.

On the top side of the sample processing chip 110 is mounted a sound source in the form of a piezo-actuator 122. The piezo-actuator 122 is hooked up to an alternating voltage source 124, which excites it into oscillation. When using a piezo-actuator, one must make sure that it is prestressed. For this purpose, in the sample processing chip of FIG. 1, pressure can be exerted on a suitable wall 111 above the sample chamber 100, which in practice is formed by a cover film on the top side. The oscillation is delivered across the wall 111 of the sample processing chip 110 opposite the cavity 116 into the liquid plug 112 and carried further by the latter. Because the input occurs in a region in direct contact with the liquid plug 112, the sound is taken directly to the fluid substance and no large losses occur from impedance differences, for example, due to a layer of air lying in between. By adjusting an appropriate frequency, the input sound can be adapted to the resonance frequency of the air bubble 118 enclosed in the cavity 116. This ensures a boosting of the amplitude of the oscillation in the cavity and, thus, an efficient utilization of the input sound.

By oscillation of the air bubble 118, the liquid column standing in the mouth region of the cavity 116 is sucked in and expelled out. The expelling of the liquid column, as shown by the arrow 126, is directional, whereas the suctioning of the liquid from the sample chamber 100 occurs from all available directions with approximately the same speed. As a result, considering one complete oscillation, there is a net momentum introduced into the liquid plug 112 in the direction of the arrow. The liquid in the plug 112 is thereby swirled and the mixing is accelerated.

The cross section of the cavity 116 is typically smaller than that of the channel or the sample processing chamber 100, so that the volume of liquid sucked in and expelled does not already comprise a major portion of the liquid volume of the entire plug 112. While the channel cross section or the height of the sample chamber 100 is typically several tens of millimeters to a few centimeters, the diameter of the cavity 116 is only several micrometers to a few millimeters, preferably a few dozen millimeters in size. The length of the cavity 116 can be 0.5 mm to 50 mm, which ensures that a sufficiently large volume of air is available for compression in the cavity 116.

Figure 2:
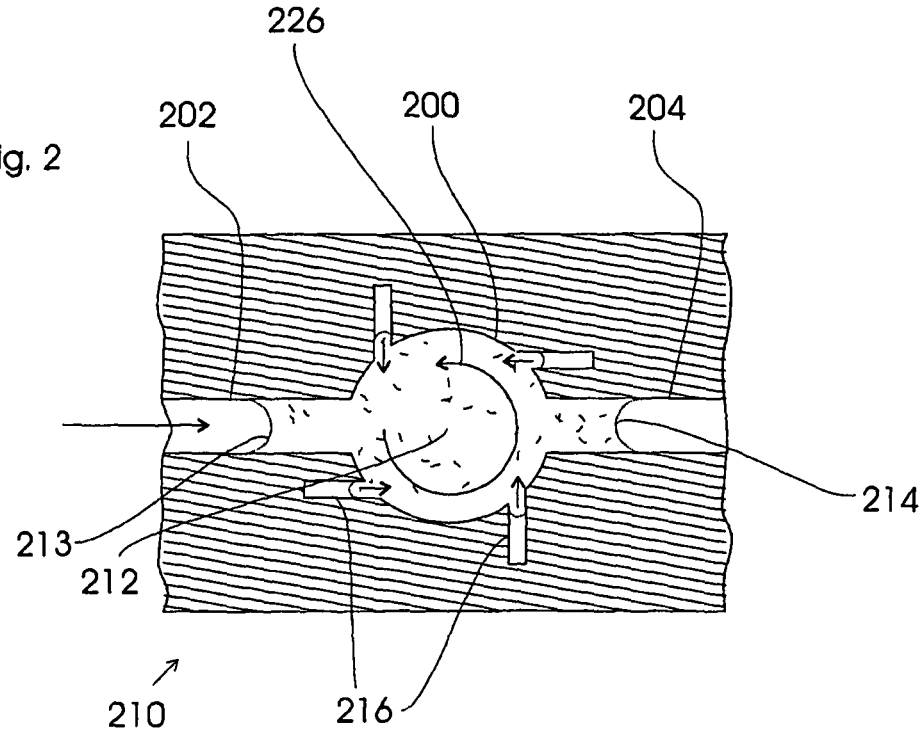
FIG. 2, the mixing device of the invention according to a second embodiment, in cross section from above.

FIG. 2 shows a sample chamber 200 in a sample processing chip 210 from above. The sample chamber 200 is bulging in the lateral dimension and of roughly circular cross section. The chamber can have a constant height, a broadening or a constriction in the vertical direction perpendicular to the plane of the drawing.

The sample chamber 200 at the inlet end is connected to a feed 202 for the fluid substance being mixed and at the outlet end to a drain 204. In the sample chamber 200 there is a liquid drop or plug 212, recognizable from the boundary surfaces 213, 214. Around the sample chamber 200 are arranged four cavities 216, emptying tangentially into it.

If sound is put into the liquid by means of a sound source (not shown), air bubbles enclosed in the cavities 216 are set in oscillation, as described in connection with the example from FIG. 1. The result is a tangential net momentum input from each cavity 216 into the liquid located in the chamber 200. The momenta add up, due to the arrangement of the four cavities 216, so that the liquid in the plug 212 is placed in rotation. This arrangement is advantageous for the mixing of rather large volumes of liquid.

A more uniform momentum input from all four cavities 216 is only ensured if the air bubbles enclosed therein have the same dimensions, since only then will all four be placed equally in resonant oscillation by the same frequency. But one can also make deliberate use of resonance differences. For example, two of the four cavities can empty into the sample chamber in opposite tangential direction. If the cavities pointing in the same direction have the same dimensions, but the oppositely working ones have different dimensions, their resonance frequencies will also be different. Thus, by coordinating the sound frequency applied, one can excite one rotation in one direction and then in the other direction in alternating fashion. This switching ensures a chaotic flow pattern and thus an even better blending of the liquid.

Figure 3:
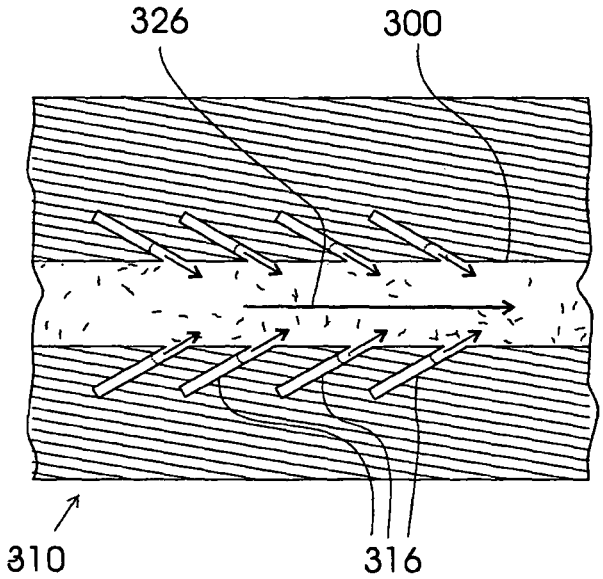
FIG. 3, a cross section through the conveyance device of the invention according to another embodiment.

FIG. 3 shows a sample embodiment of the invented conveyance device in cross section, again comprising a sample chamber 300 in the form of a channel in a sample processing chip 310. Moreover, the conveyance device has several cavities 316, which empty at an acute angle to the lengthwise axis of the channel 300 into it. In the channel 300 there is a liquid, which penetrates in the above described manner into the mouths of the cavities 316 and then encloses an air bubble each time. If this is placed in pressure oscillation by a sound source, then the liquid column in the already described manner will be delivered out from the mouth region of each cavity (synchronously). The momentum inputs to the liquid located in the channel add up to a net linear momentum in the direction of the channel axis, indicated by the arrow 326. In this way, a micropump device is created.

Figure 4:
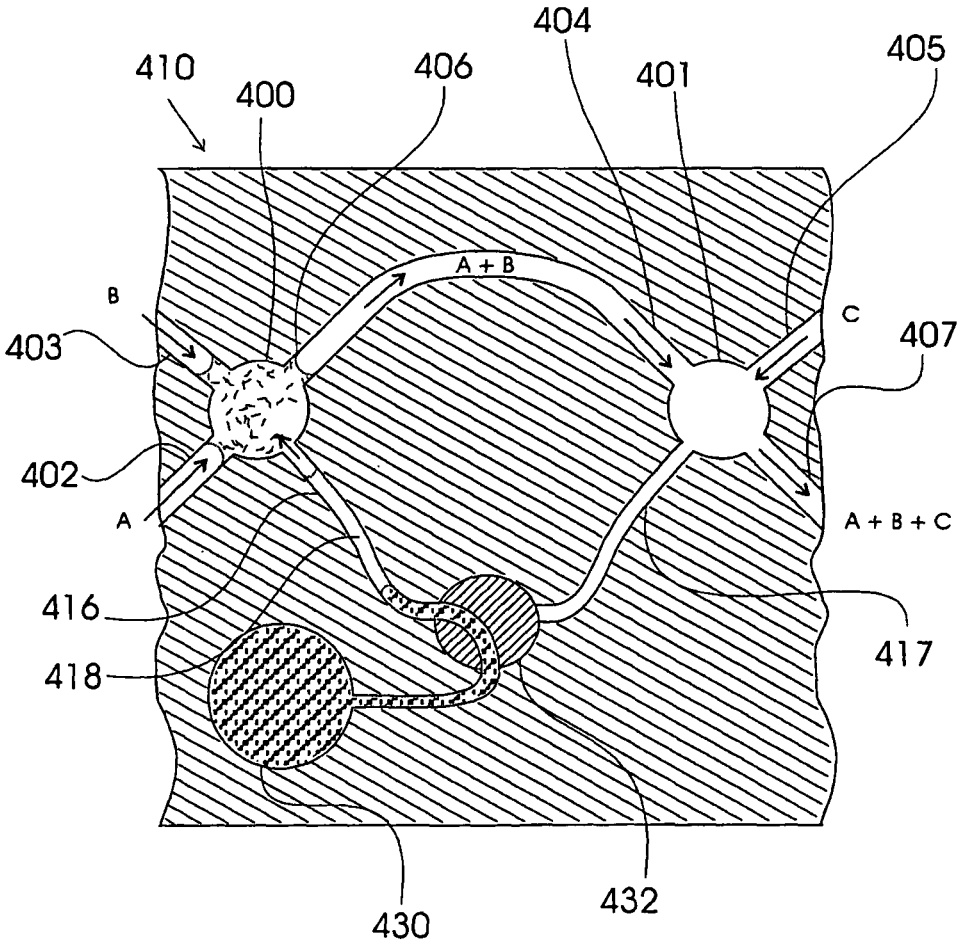
FIG. 4, a sample processing chip with two mixing devices, one switched behind the other, and external pressure chamber, in cross section from above.

FIG. 4 shows a cutout of a sample processing chip 410 with two sample chambers 400, 401, into each of which two feeds 402, 403 and 404, 405 empty. The sample chambers are switched immediately one behind the other, so that the drain 406 of the first sample chamber 400 empties directly into one of the feeds 404 of the second sample chamber 401. Thus, while in sample chamber 400 the substances A and B introduced by the feed 402 and 403 are mixed to form a mixed substance A+B, in the second sample chamber 401 the mixed substance A+B is mixed with a further substance C to form the mixed substance A+B+C.

The mixing is done by the already described principle. One cavity each, 416 or 417, empties into the two sample chambers. If the liquid plug from the two initially unmixed substances A and B is present in the first sample chamber 400, an air or gas bubble 418 is enclosed in the cavity 416. Contrary to the already described sample embodiments, however, the cavity 416 is not a blind borehole closed at one end, but instead a connection line joined at the back side to a pressure chamber 430, which is filled with a coupling medium. The air bubble 418 is enclosed between the substance being mixed, on the one hand, and the coupling medium, on the other. A sonic field is introduced into the coupling medium in the already described manner, preferably by applying a sound source in the region of the pressure chamber 430. This puts out the oscillation to the air or gas bubble, which pulsates thanks to its compressibility and causes the fluid substance to flow in the mount of the cavity.

When the two substances A and B are sufficiently mixed, the liquid plug of the mixed substance A+B is transported toward the second sample chamber 401, where it is combined with substance C.

The pressure chamber can be connected by a branching system of lines both to the cavity 416 emptying into the first sample chamber 400 and to the cavity 417 emptying into the second sample chamber 401. Therefore, one needs only one sound source connected to the common pressure chamber 430 for the mixing in the two sample chambers 400, 401.

A valve 432 installed in the line of the coupling medium is switched over after the mixing process in the first sample chamber 400, so that now only the cavity 417 emptying into the second sample chamber 401 is connected to the pressure chamber 430. An air bubble enclosed in the cavity 417 (not shown) can now be placed in oscillation by the coupling medium and the substances A, B and C will be mixed.

The feeding and draining of the substances A, B and C occurs through a suitable valve system, not otherwise shown, to make sure that the substances take the proper path and remain in the respective mixing chambers during the mixing.

Figure 5:
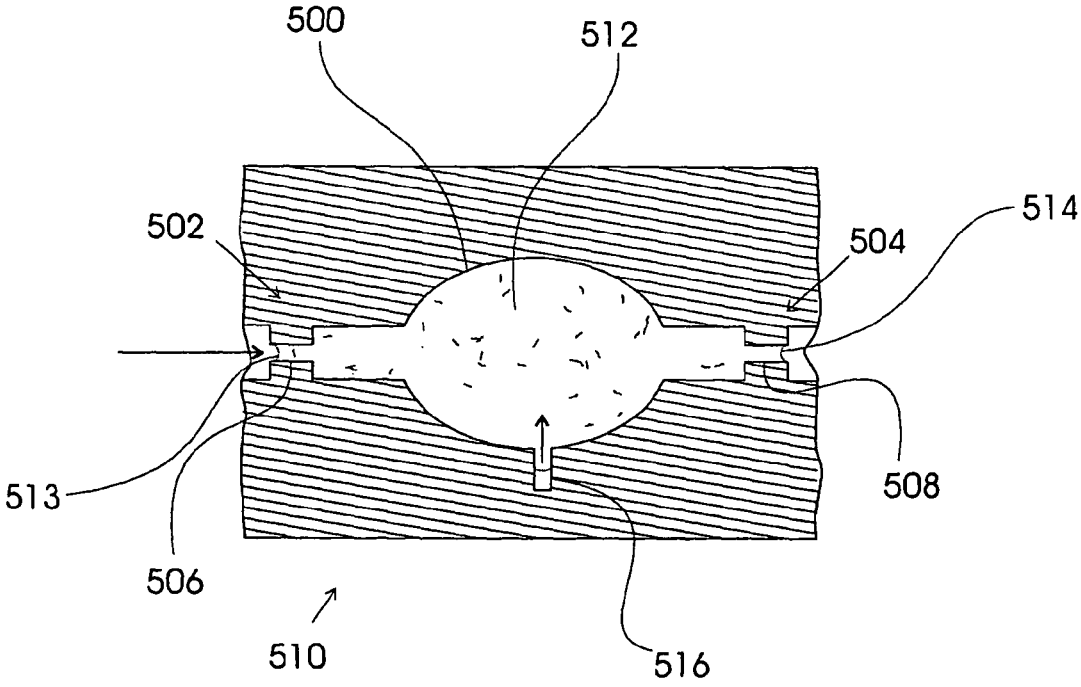
FIG. 5, a cross section through the mixing device of the invention in a sample processing chip according to another embodiment, viewed from above.

FIG. 5 shows yet another simple embodiment of the mixing device of the invention in a sample processing chip 510. A sample chamber 500 is formed in the shape of a volume bulging in the lateral dimension. The chamber 500 can have a constant height, a broadening or a constriction in the vertical direction perpendicular to the plane of the drawing.

The sample chamber 500 is connected at the inlet end to a feed 502 for the fluid substance being mixed and at the outlet end to a drain 504. Contrary to the sample chamber of FIG. 2, the feed and the drain each have bottlenecks or constrictions 506 and 508. In the sample chamber 500 there is a liquid drop or plug 512, recognizable from the boundary surfaces 513, 514. The volume of the liquid drop 512 is attuned to the volume of the chamber so that the boundary surfaces 513, 514 come to lie in the region of the bottlenecks 506, 508. This has two benefits: the liquid drop 512 can be held more easily in the sample chamber and the introduced sound can be utilized more efficiently thanks to the small surfaces 513, 514 bounding off from the surroundings—less sonic energy is dissipated. The liquid drop 512 is more easily held or positioned in that the surface of the chamber 500 and the feed and drain 502, 504 are preferably wettable in design. Thus, the fluid substance penetrates into the bottlenecks and is halted at their transition to the next segment of the drain 504 in the direction of flow. In order to move the liquid further out from the chamber 500, energy must be expended, since an enlarging of the surface occurs. The liquid is therefore held securely in the chamber until enough energy is expended for the further transport.

The cavity 516 in this case is located centrally and transversely to the axis formed by the feed and the drain. As in the example of FIG. 1, it is in the form of a small, unvented channel or a blind borehole. The principle of functioning is the same. The sample embodiments shown for the mixing device of the invention are especially suited for continuous or quasicontinuous operation. By quasicontinuous is meant in this context a sequentially working mixing device, in which individual volumes of liquid are taken through the sample chamber and mixed one after the other.

The sample chamber—regardless of its shape otherwise—is preferably formed without sharp corners or edges and with the most streamlined possible form, so that no liquid residues remain at places of poor flow or in the corners and edges, and the chamber can be filled and emptied as completely as possible.

Figure 6:
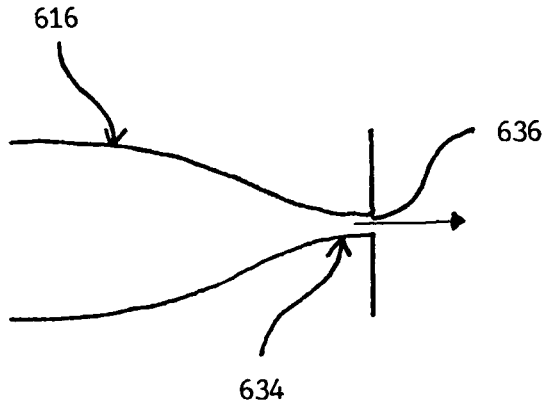
FIG. 6, a cross section through the nozzlelike mouth region of a cavity.

This also preferably pertains to the cavity 616 of the invented mixing and/or conveyance device, which has a mouth 634 in the form of a nozzle with a streamlined tapering cross section of its mouth in the direction of the opening 636 and a sharp cutoff edge in the plane of the opening, as shown schematically in FIG. 6.

LIST OF REFERENCE SYMBOLS

100 Sample chamber/channel
110 Sample processing chip
111 Wall
112 Liquid drop/plug
113 Boundary surface
114 Boundary surface
116 Cavity
118 Air bubble
120 Boundary surface
122 Piezoactuator
124 Alternating voltage source
126 Momentum
200 Sample chamber
202 Feed
204 Drain
210 Sample processing chip
212 Liquid drop/plug
213 Boundary surface
214 Boundary surface
216 Cavity
226 Angular momentum
300 Sample chamber
310 Sample processing chip
316 Cavity
326 Net momentum
400 Sample chamber
401 Sample chamber
402 Feed
403 Feed
404 Feed
405 Feed
406 Drain
407 Drain
410 Sample processing chip
416 Cavity
417 Cavity
418 Air bubble
430 Pressure chamber
432 Valve
500 Sample chamber
502 Feed
504 Drain
506 Bottleneck
508 Bottleneck
510 Sample processing chip
512 Liquid drop/plug
513 Boundary surface
514 Boundary surface

516 Cavity
616 Cavity
634 Mouth region
636 Opening

What is claimed is:

1. A mixing and/or conveyance device for a fluid substance comprising: a sample chamber, at least one cavity communicating with the sample chamber, designed to accommodate a compressible medium of given volume, wherein a surface of the cavity is arranged to be non-wettable, at least in part, and wherein the surface of the cavity is further arranged to be wettable in a mouth region, and a sound source that may be coupled to the compressible medium for the production of a fluctuation in pressure in the compressible medium, wherein the cavity is configured in the mouth region so that, in the case of an expansion in the volume of the compressible medium in the cavity, a directed fluid stream of the fluid substance escapes from the cavity through its mouth.

2. The mixing and/or conveyance device according to claim 1, further including a pressure-increasing means in communication with the sample chamber, which is designed to apply a pressure to the fluid substance so that a portion of the fluid substance penetrates into the mouth region of the cavity under compression of the compressible medium.

3. The mixing and/or conveyance device according to claim 1, wherein the mouth region of the at least one cavity is arranged and oriented relative to the sample chamber so that the directed fluid streams exiting from the cavities through the mouths introduce a sum angular momentum into the fluid substance inside the sample chamber.

4. The mixing and/or conveyance device according to claim 1, wherein the mouth region of the at least one cavity is arranged and oriented relative to the sample chamber so that the directed fluid streams exiting from the cavities through the mouths introduce a sum linear momentum into the fluid substance inside the sample chamber.

5. The mixing and/or conveyance device according to claim 1, wherein the cavity is inserted in the form of a blind borehole into one wall of the sample chamber.

6. The mixing and/or conveyance device according to claim 1, wherein the sound source is coupled directly to a wall of the sample chamber.

7. The mixing and/or conveyance device according to claim 1, wherein the cavity is in the form of a connection channel, which is connected on the one hand via the mouth to the sample chamber and on the other hand to a pressure chamber filled with a coupling medium, to which the sound source is coupled.

8. The mixing and/or conveyance device according to claim 1, wherein the compressible medium is a gas.

9. The mixing and/or conveyance device according to claim 1, wherein the compressible medium is air.

10. A sample processing chip with a mixing and/or conveyance device according to claim 1.

11. A mixing and/or conveyance device for a fluid substance comprising: a sample chamber, wherein a feed for the fluid substance is connected at an inlet of the sample chamber and a drain is connected at an outlet of the sample chamber, at least one cavity communicating with the sample chamber, designed to accommodate a compressible medium of given volume, wherein a surface of the cavity is arranged to be non-wettable, at least in part, and wherein the surface of the cavity is further arranged to be wettable in a mouth region, and a sound source that may be coupled to the compressible medium for the production of a fluctuation in pressure in the compressible medium, wherein the cavity is configured in the mouth region so that, in the case of an expansion in the volume of the compressible medium in the cavity, a directed fluid stream of the fluid substance escapes from the cavity through its mouth.

12. The mixing and/or conveyance device according to claim 11, further including a pressure-increasing means in communication with the sample chamber, which is designed to apply a pressure to the fluid substance so that a portion of the fluid substance penetrates into the mouth region of the cavity under compression of the compressible medium.

13. The mixing and/or conveyance device according to claim 11, wherein the mouth region of the at least one cavity is arranged and oriented relative to the sample chamber so that the directed fluid streams exiting from the cavities through the mouths introduce a sum angular momentum into the fluid substance inside the sample chamber.

14. The mixing and/or conveyance device according to claim 11, wherein the mouth region of the at least one cavity is arranged and oriented relative to the sample chamber so that the directed fluid streams exiting from the cavities through the mouths introduce a sum linear momentum into the fluid substance inside the sample chamber.

15. The mixing and/or conveyance device according to claim 11, wherein the cavity is inserted in the form of a blind borehole into one wall of the sample chamber.

* * * * *